US006056916A

United States Patent [19]

Hauner

[11] Patent Number: 6,056,916

[45] Date of Patent: May 2, 2000

[54] PROCESS FOR PRODUCING A PRODUCT MADE OF A CONTACT MATERIAL BASED ON SILVER, CONTACT MATERIAL AND PRODUCT MADE OF THE CONTACT MATERIAL

[75] Inventor: Franz Hauner, Röttenbach, Germany

[73] Assignee: Metalor Contacts Deutschland GmbH, Redwitz, Germany

[21] Appl. No.: 09/243,833

[22] Filed: Feb. 1, 1999

Related U.S. Application Data

[63] Continuation of application No. PCT/DE97/01569, Jul. 24, 1997.

[51] Int. Cl.[7] ..... B22F 3/00

[52] U.S. Cl. ..... 419/21; 419/31

[58] Field of Search ..... 419/21, 31

[56] References Cited

U.S. PATENT DOCUMENTS

| | | | |
|---|---|---|---|
| 2,394,501 | 2/1946 | Weller . | |
| 3,954,459 | 5/1976 | Schreiner et al. . | |
| 5,429,656 | 7/1995 | Hauner et al. | 75/232 |
| 5,663,500 | 9/1997 | Hauner et al. | 75/232 |
| 5,796,017 | 8/1998 | Hauner | 75/232 |
| 5,808,213 | 9/1998 | Weise et al. | 75/247 |

*Primary Examiner*—Ngoclan Mai
*Attorney, Agent, or Firm*—Herbert L. Lerner; Laurence A. Greenberg; Werner H. Stemer

[57] ABSTRACT

A process for producing a product made of a contact material. The contact material is formed of a powder mixture containing silver and iron as a main active component. The iron is an iron powder having an average particle size in excess of 1 $\mu$m. Further processing of the powder mixture using powder metallurgy methods are performed for forming a product in which the iron has been oxidized to an iron oxide.

10 Claims, No Drawings

PROCESS FOR PRODUCING A PRODUCT MADE OF A CONTACT MATERIAL BASED ON SILVER, CONTACT MATERIAL AND PRODUCT MADE OF THE CONTACT MATERIAL

CROSS REFERENCE TO RELATED APPLICATION

This application is a continuation of International Application PCT/DE97/01569, filed Jul. 24, 1997, which designated the United States.

BACKGROUND OF THE INVENTION

Field of the Invention

The invention relates to a process for producing a product made of a contact material based on silver with iron oxide as the main active component. The invention also relates to a contact material and to a product made of such a contact material, in particular a contact piece for power-engineering switching equipment.

For a contact piece in power-engineering switching equipment, for example a power circuit breaker, as well as in DC, motor or auxiliary protection, contact materials based on silver containing particular active components have long been found to be suitable. Known active components that have a favorable effect on the switching properties of the contact material include both metals and metal oxides. Examples of metallic contact materials based on silver include silver/nickel (AgNi) and silver/iron (AgFe). Examples of oxide contact materials include, in particular, silver/iron oxide ($AgFe_2O_3$).

The practical applicability of the contact material is determined by its electrical contact properties. The most important parameters in this regard are its life measured in the number of switching operations, which is determined by the erosion of the contact piece, the so-called overtemperature which results from the contact heating at the contact bridge and the terminals, susceptibility to welding and resistance to corrosion.

In order to measure the switching properties of a contact material, a testing switch described in Z.f. Werkstofftechnik/J. of Materials Technologies 7 (1976), pages 381 to 389 is customarily used, in which a contact piece made of the contact material is respectively placed.

Silver/nickel contact materials, in particular, have good switching properties but they have the disadvantage that nickel dust formed by friction in production or during operation, and nickel oxide formed as a product of the switching, can have harmful effects on the human body.

As a replacement material for the silver/nickel contact materials, Published, Non-Prosecuted German Patent Application DE 43 28 281 A discloses an oxide contact material based on silver, which contains iron oxide in proportions by mass of from 3% to 20% as the main active component, and at least one oxide of an element from the third subgroup of the Periodic Table in a proportion by mass of from 0.1% to 10% as a further active component. The use of yttrium oxide, in particular, as a further active component is in this respect regarded as particularly advantageous for the contact properties of such a contact material.

Likewise, Published, Non-Prosecuted German Patent Application DE 44 10 462 A describes a contact material based on silver with iron oxide as the main active component. In order to improve the contact properties, besides an oxide of an element in the third subgroup of the Periodic Table, in particular yttrium oxide, at least one metal oxide of an element in the 6th subgroup of the Periodic Table is also added. In particular, iron tungstate ($FeWO_4$) reduces the contact heating and the susceptibility to welding, and increases the life of the contact material.

Furthermore, Published, Non-Prosecuted German Patent Application DE 41 17 311 A discloses a contact material based on silver, which contains iron oxide in proportions by mass of between 1% and 50% as the active components, and an oxide of another chemical element in proportions by mass of between 0.01% and 5%. It has in this case been found that the thermal behavior, in particular, of a silver/iron oxide contact material can be favorably affected by adding rhenium oxide, bismuth zirconate, boron oxide, zirconium oxide, molybdenum oxide or tungsten oxide.

As the production process for a contact material based on silver with iron oxide as the main active component, the Published, Non-Prosecuted German Patent Applications DE 43 28 281 A, DE 41 17 311 A and DE 44 10 462 A describe the mixing of suitable amounts of silver power, iron oxide powder and powder made up of other active components, and further processing the resultant powder mixture using powder metallurgy methods to form a semi-finished product or a shaped article. Commercially available powders are in this case exclusively used for the aforementioned powders.

There are essentially two different known powder metallurgy methods for producing a shaped article made of the contact material.

In the molding technique, the powder mixture is compressed by compression molding to give a molding which is processed further by sintering and, where appropriate, further compression to give a finished shaped article. For the production of a shaped article in the form of a contact piece, the molding may be further compression-molded with a layer of pure silver for secure connection of the contact piece to the support by hard soldering.

In the extrusion technique, the powder mixture is firstly compressed and/or sintered to give a porous preform or bar. The preform or bar is, where appropriate together with a layer of pure silver, extruded to give a rod from which the shaped articles are cut, and optionally subjected to a subsequent treatment.

A disadvantage of the silver/iron oxide contact materials produced by mixing silver powder with commercially available oxide powders is that it is difficult to alter their shape. Such contact materials are unsuitable for the production of rivets, in particular rivets with a large head/stem ratio. Since the head of the rivet is generally formed by compressive deformation of a shaped article in the form of a wire, one prerequisite for the material used is that its shape can be readily altered.

SUMMARY OF THE INVENTION

It is accordingly an object of the invention to provide a process for producing a product made of a contact material based on silver, a contact material and a product made of the contact material that overcome the above-mentioned disadvantages of the prior art methods, devices and products of this general type, which have outstanding switching properties, and whose shape can be altered considerably more easily than compared with the prior art. A further object of the invention is to provide such a contact material, as well as a product, in particular in the form of a rivet, made of the contact material, which is particularly suitable for use in power engineering.

With the foregoing and other objects in view there is provided, in accordance with the invention, a process for producing a product made of a contact material, which includes: forming a powder mixture containing silver and iron as a main active component, the iron being an iron powder having an average particle size in excess of 1 μm; and processing further the powder mixture using powder metallurgy methods for forming a product with the iron being oxidized to iron oxide.

Other features which are considered as characteristic for the invention are set forth in the appended claims.

Although the invention is described herein as embodied in a process for producing a product made of a contact material based on silver, a contact material and a product made of the contact material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

DESCRIPTION OF THE PREFERRED EMBODIMENTS

A process for producing a product made of a contact material based on silver with iron oxide as the main active component, is achieved by firstly forming a powder mixture of silver Ag and iron Fe, in which the iron Fe is in the form of a powder having an average particle size in excess of 1 μm. The powder mixture is then further processed using powder metallurgy methods to form a shaped article with the iron Fe being oxidized to iron oxide $Fe_2O_3/Fe_3O_4$.

With regard to the contact material, the contact material is based on silver with the iron oxide as the main active component, which includes silver and iron oxide $Fe_2O_3/Fe_3O_4$. The average particle size of the iron oxide being in excess of 1 μm, preferably in excess of 3 μm.

The invention is based on the discovery that the ease with which it is possible to alter the shape of the contact material based on silver with iron oxide as the main active component is essentially determined by the average particle size of the iron oxide particles in the silver matrix. Within an average iron-oxide particle size range of from 1 μm to 10 μm, such a contact material having a large average particle size of the iron oxide particles can have its shape altered more readily than a contact material having a small average particle size. With conventional production processes, however, it is not possible to produce a silver/iron oxide contact material which has iron oxide particles having an average particle size in excess of 1 μm, since iron oxide powders are commercially available only with an average particle size of less than 1 μm.

However, since iron powders whose average particle size is in excess of 1 μm are available, it is possible by using iron power instead of iron oxide powder, and subsequently oxidizing the iron to give iron oxide, to obtain a contact material in which the average particle size of the iron oxide particles is in a range in excess of 1 μm. The iron oxide may in this case be pure $Fe_2O_3$ or $Fe_3O_4$, or a mixture of these oxides. Since no extra working step is needed in comparison with conventional production processes, the process according to the invention is particularly cost-efficient.

The term product should in this case be taken to refer to a contact material in any form. A straightforward powder mixture, or a loosely compressed powder mixture, the iron not yet having been oxidized to give iron oxide, does not constitute a product in this sense. The bars, in which iron has been oxidized to give iron oxide or a finished shaped article are, however, such products.

In order to obtain good contact properties as well as easy shape alteration, it is advantageous to use iron in the form of a powder having an average particle size in excess of 3 μm.

The iron is advantageously oxidized in the powder mixture, since the increasing density of the powder mixture in the subsequent working steps makes complete oxidation more difficult. It is, however, also possible for the oxidation to be carried out in a blank of the product, which is still porous enough or permeable enough to gases. An example of such a blank is, for example, the bar required for the extrusion technique, which is subsequently compressed to form a rod. Such a blank may also be a preform produced in the molding technique for a molding.

The iron is preferably oxidized by heat treatment in an oxidizing atmosphere, preferably in air or oxygen. The heat treatment is in this case advantageously carried out at a temperature of from 500° C. to 1000° C., preferably at about 700° C.

For the contact properties of the contact material, or the product made of the contact material, it is advantageous if zirconium oxide $ZrO_2$ or rhenium oxide $ReO_2/ReO_3/Re_2O_7$ is used as the oxide of another metal. The rhenium oxide may in this case be pure $ReO_2$, $ReO_3$ or $Re_2O_7$, or may also be a mixture of the oxides. A particular known feature of these metal oxides is that they favorably affect, i.e. reduce, the overtemperature which results from the contact heating and essentially depends on the electrical resistance of the contact bridge.

The switching properties of the contact material can be favorably affected by adding other metals and/or other metal oxides to the powder mixture. For example, metals from the 3rd and 6th subgroups of the Periodic Table and/or oxides of these metals are favorable for the switching properties.

The contact material has favorable switching properties if the iron oxide $Fe_2O_3/Fe_3O_4$ is in a proportion by mass of between 1% and 50%, and the other metal oxide is in a proportion by mass of between 0.01% and 5%.

The object with regard to the product is achieved by a product made of a contact material based on silver, which includes silver and, as its main active component, iron oxide. The average particle size of the iron oxide being in excess of 1 μm, preferably in excess of 3 μm. In particular, the contact material is especially suitable for a contact piece in the form of a rivet for power-engineering switching equipment, for example a low-voltage circuit breaker.

I claim:

1. A process for producing a product made of a contact material, which comprises:

forming a powder mixture containing silver and iron as a main active component, the iron being an iron powder having an average particle size in excess of 1 μm; and processing further the powder mixture using powder metallurgy methods forming a product with the iron being oxidized to an iron oxide.

2. The process according to claim 1, which comprises providing the iron powder with an average particle size in excess of 3 μm.

3. The process according to claim 1, which comprises oxidizing the iron in the powder mixture.

4. The process according to claim 1, which comprises forming the powder mixture into a blank for forming the product and subsequently oxidizing the iron in the blank.

5. The process according to claim 1, which comprises oxidizing the iron with a heat treatment in an oxidizing atmosphere.

6. The process according to claim 5, which comprises using one of air and oxygen as the oxidizing atmosphere.

7. The process according to claim 5, which comprises carrying out the heat treatment step at a temperature of from 500° C. to 1000° C.

8. The process according to claim 5, which comprises carrying out the heat treatment step at a temperature of approximately 700° C.

9. The process according to claim 1, which comprises adding at least one of an oxide of at least one other metal and at least one other metal to the powder mixture.

10. The process according to claim 9, wherein the oxide of the at least one other metal is selected from the group consisting of zirconium oxide and rhenium oxide.

* * * * *

UNITED STATES PATENT AND TRADEMARK OFFICE

CERTIFICATE OF CORRECTION

PATENT : 6,056,916

DATED : May 2, 2000

INVENTOR(S) : Franz Hauner

It is certified that error appears in the above-identified patent and that said Letters Patent is hereby corrected as shown below:

On the title page, after item [63] Related U.S. Application Data, insert the following:

--[30] Foreign Application Priority Data

Aug. 1, 1996 [DE] Germany.....196 31 141--.

Signed and Sealed this

Eighth Day of August, 2000

*Attest:*

*Attesting Officer*

Q. TODD DICKINSON

*Director of Patents and Trademarks*